United States Patent [19]

Peterson

[11] 3,964,207

[45] June 22, 1976

[54] PIVOT ARRANGEMENT FOR TRANSFERRING PRESSURIZED AIR INTO A PIVOT DOOR

[75] Inventor: Francis C. Peterson, St. Louis County, Mo.

[73] Assignee: C. Hager & Sons Hinge Manufacturing Company, St. Louis, Mo.

[22] Filed: Mar. 24, 1975

[21] Appl. No.: 561,048

[52] U.S. Cl. ..... 49/388; 16/168; 49/70; 49/167; 49/394

[51] Int. Cl.[2] ..... E05D 7/08

[58] Field of Search ..... 49/167, 70, 388, 394, 49/477; 16/168, 169, 137, 161

[56] References Cited

UNITED STATES PATENTS

| | | | |
|---|---|---|---|
| 2,093,201 | 9/1937 | Love | 49/167 |
| 2,294,792 | 9/1942 | Miller | 49/388 |
| 2,571,379 | 10/1951 | Parsons | 49/167 |
| 3,086,257 | 4/1963 | Haguet | 49/167 |
| 3,156,019 | 11/1964 | Dawley | 49/167 |

*Primary Examiner*—Paul R. Gilliam
*Assistant Examiner*—Kenneth J. Dorner
*Attorney, Agent, or Firm*—Gravely, Lieder & Woodruff

[57] ABSTRACT

A pivot arrangement at the upper end of a pivot door includes a bushing on the door and a hollow pivot pin projected from the door frame header into the bushing. Fluid conduits are connected with the pin and the bushing so that the conduits are in communication through the pivot arrangement. Pressurized air is transmitted through the conduits and pivot arrangement to a pneumatic appliance on the door.

4 Claims, 5 Drawing Figures

FIG. 1
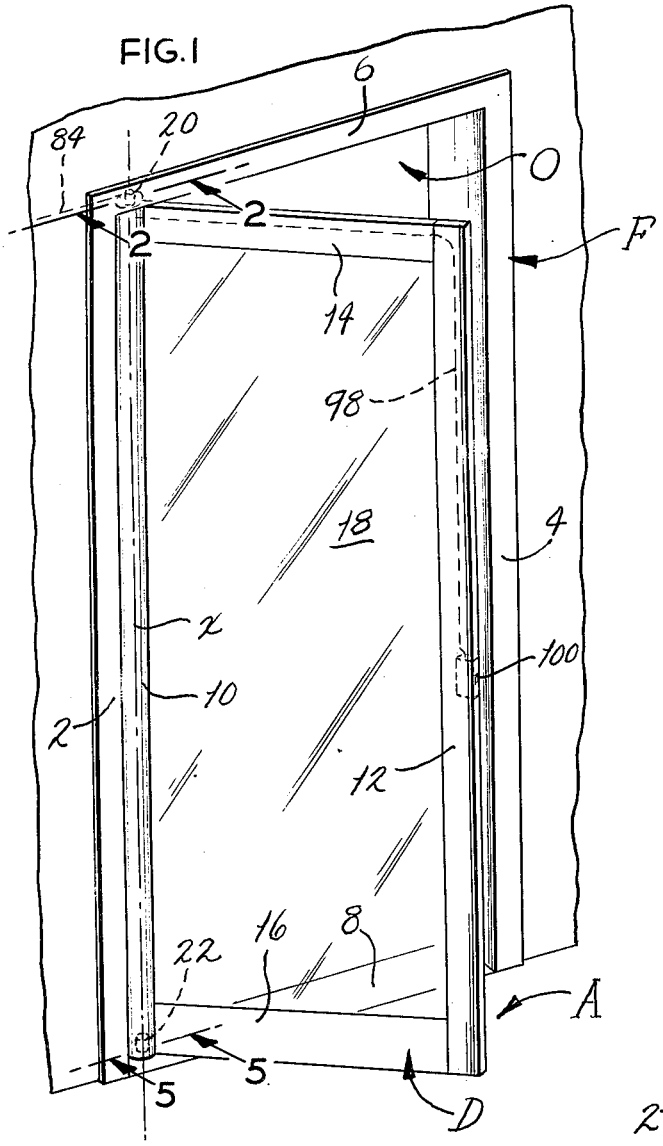
FIG. 3
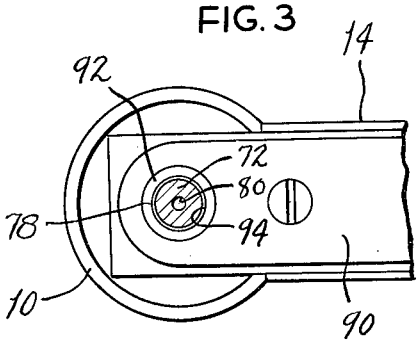
FIG. 4
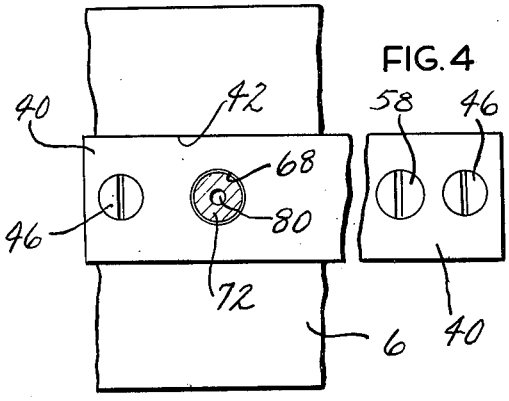
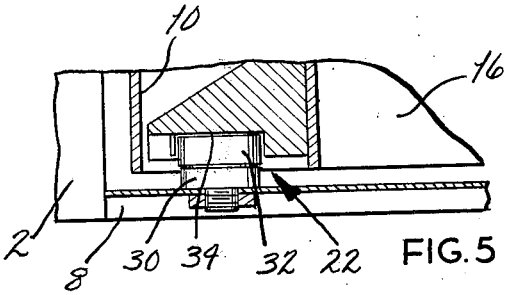
FIG. 5
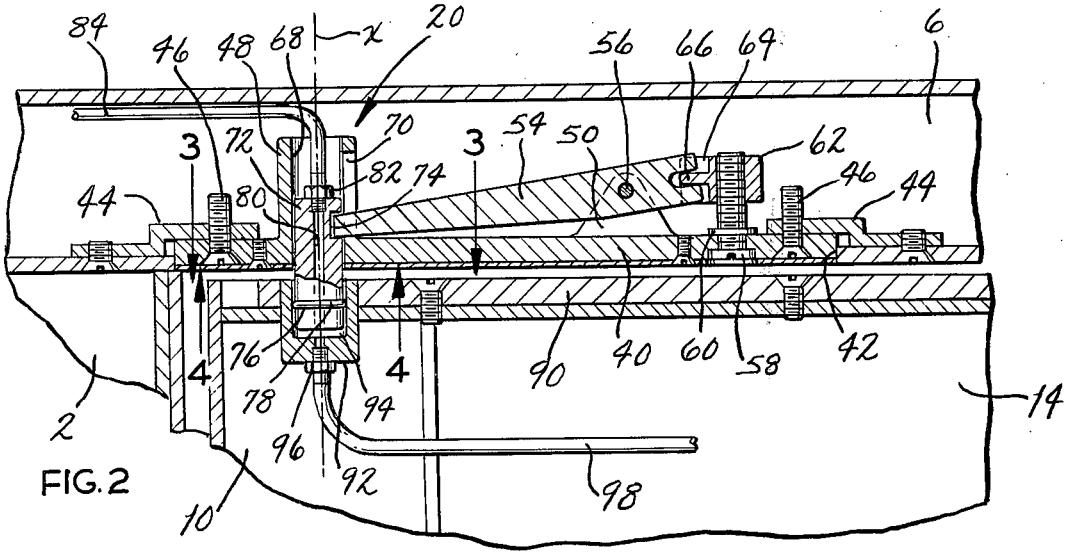
FIG. 2

PIVOT ARRANGEMENT FOR TRANSFERRING PRESSURIZED AIR INTO A PIVOT DOOR

BACKGROUND OF THE INVENTION

This invention relates in general to pivot devices for doors and more particularly to a pivot arrangement capable of transmitting pressurized air into a door.

some doors are provided with air-operated appliances, and to actuate these appliances pressurized air must be introduced into the door from the surrounding frame. For example, a door may be provided with an air-operated door opener which is supplied with air when a panic bar or handle on the door is depressed to assist an individual opening the door. Likewise, the door may be provided with an air-operated lock or an air cylinder to hold the door open in an emergency. Some air-operated appliances for doors are illustrated in U.S. patent application Ser. No. 492,445 of Francis C. Peterson, filed July 29, 1974 and entitled DOOR EXIT FIXTURE WITH PHEUMATIC MEANS FOR MAINTAINING A LATCH BOLT IN ITS RETRACTED POSITION, and in U.S. patent application Ser. No. 533,961 of Francis C. Peterson, filed Dec. 18, 1974 and entitled ENTRY STRUCTURE AND AIR-OPERATED LOCK THEREFOR.

The principal advantage of pneumatically operated door appliances over electrically operated appliances is that the former operate without conducting electrical current through the door. In this connection, it should be noted that many building codes severely limit the magnitude of electrical voltage and current which may be introduced into a door circuit, and usually the maximum voltage and current are enough to operate only a very light solenoid. These solenoids do not develop enough force power for most door mounted appliances.

The normal procedure for introducing air into a door to operate door mounted appliances is to install a looped hose between the hinge jamb and the adjoining side of the door. This hose, of course, flexes as the door is opened and closed, and the flexure is particularly pronounced with so called pivot doors which possess the capability of swinging in both directions out of the door opening. The constant flexing eventually causes the hose to crack. Moreover, the flexible hose is exposed where it can be tampered with or inadvertently torn loose.

SUMMARY OF THE INVENTION

One of the principal objects of the present invention is to provide a pivot arrangement which enables a door to pivot relative to the opening it normally closes and which further transmits pressurized air into the door for operating door mounted appliances. Another object is to provide a pivot arrangement of the type stated which transmits the air without exposing the air lines through which the pressurized air is transmitted. A further object is to provide a pivot arrangement of the type stated which is simple in construction and economical to manufacture. These and other objects and advantages will become apparent hereinafter.

The present invention is embodied in means on a door and surrounding structure for enabling the door to pivot relative to the surrounding structure and for further enabling pressurized fluid to be transmitted into the door. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of a pivot door provided with the pivot arrangement of the present invention and having a pneumatic appliance thereon which is operated by pressurized air transmitted through the pivot arrangement;

FIG. 2 is a sectional view taken along line 2—2 of FIG. 1 and showing the upper pivot arrangement through which pressurized air is transmitted;

FIG. 3 is a sectional view taken along line 3—3 of FIG. 2 and showing the door bushing which forms part of the upper pivot arrangement;

FIG. 4 is a sectional view taken along line 4—4 of FIG. 2 and showing the underside of the plate which carries the pivot pin of the upper pivot arrangement; and FIG. 5 is a sectional view taken along line 5—5 of FIG. 1 and showing the lower pivot arrangement.

DETAILED DESCRIPTION

Referring now to the drawings (FIG. 1), a door D is mounted within a door frame F which extends upwardly from a floor A. When the door D is completely within the frame F, it closes an opening O defined by the frame F. The door D, however, will swing in either direction out of the opening O, permitting access through the opening O.

The door frame F includes jambs 2 and 4 along its sides and a header 6 connecting the upper ends of the jambs 2 and 4. Secured to the floor A between the lower ends of the jambs 2 and 4 is a threshold 8.

The door D includes upright side rails 10 and 12 which are located adjacent to the jambs 2 and 4, respectively, when the door D is closed, and top and bottom rails 14 and 16 which connect the ends of the side rails 10 and 12. When the door D is closed, the top rail 14 is located directly below the header 6, whereas the bottom rail 16 is located directly above the threshold 8. The area circumscribed by the door rails 10, 12, 14 and 16 is enclosed by a sheet 18 of tempered glass, plastic, or some other suitable material. The door D is connected to both the header 6 and at an upper pivot arrangement or mechanism 20 and to the threshold 8 at a lower pivot arrangement or mechanism 22. The pivot mechanisms 20 and 22 enable the door D to swing in both directions out of the opening O about a vertical pivot axis X located slightly inwardly from the jamb 2.

The lower pivot mechanism 22 (FIG. 5) includes a fixed base 30 which is projected upwardly from the threshold 8 and serves as a journal for a roller 32. Balls or other suitable antifriction elements are interposed between the roller 32 and the base 30 to enable roller 32 to rotate freely on the base 30. The antifriction elements are arranged such that the roller 32 will carry downwardly directed thrust loading as well as radial loading. The roller 32 fits into a downwardly opening socket 34 in the bottom rail 16 of the door D. The positioning of the socket 34 and the roller 32 is such that the side rail 10 of the door D is located far enough from the jamb 2 of the frame F to avert interference between the two when the door D is opened or closed. The clearance between the rail 10 and the jamb 2 may be reduced to a minimum by rounding off the back of the rail 10.

The upper pivot mechanism 22 (FIGS. 2–4) is somewhat more complicated. It includes (FIG. 2) a mounting plate 40 which is received in a recess 42 formed in the header 6 directly above the door D. Thus, the recess 42 opens downwardly. The back or upper side of the plate 40 bears against a pair of lugs 44 which are fastened to the header 6 and project over the recess 42. The plate 40, which is preferably a die casting, is secured to these lugs 44 by machine screws 46. While the underside or bottom of the plate 40 is flat, the upper surface has a cylindrical boss 48 and a bifurcated pivot tab 50. The cylindrical boss 48 axially aligns with the roller 32 on the threshold 8.

The bifurcated pivot tab 50 forms a fulcrum for an actuating lever 54 (FIG. 2) which fits between the two portions of the tab 50 and pivots on a cross pin 56 carried by the tab 50. One end of the actuating lever 54 is bifurcated. Beyond the bifurcated end of the lever 54 is an adjusting screw 58 which is extended through the plate 40. The head of the screw 58 is slotted and is recessed into the plate 40 such that the slot of the screw 58 is exposed downwardly and can be turned from beneath the header 6. At the upper surface of the plate 40 the shank of the screw 58 is embraced by a snap ring 60 which snaps into a groove therein. The snap ring 60 and the screw head prevent the screw 58 from moving in the axial direction, but do not impair rotation thereof. The screw 58 threads through a nut 62 having a pair of wings 64 which extend along both sides of the lever 54 at the bifurcated end thereof and keep the nut 62 from turning with the screw 58, irrespective of the direction in which the screw 58 is turned. The space between the two wings 64 is traversed by a rib 66 which fits into the notch in the bifurcated end of the lever 54. Thus, that end of the lever 54 will follow the nut 62 as it moves upwardly and downwardly on the adjusting screw 58. The opposite end of the lever 54 is at the cylindrical boss 48.

The cylindrical boss 48 contains a bore 68 which is coaxial with the pivot axis X for the door D and further has a vertical slot 70 into which the end of the lever 54 extends. Indeed, the lever 54 is long enough to extend into the bore 68.

The bore 68 of the boss 48 contains a retractable pivot pin 72 which along its side has a notch 74 just large enough to receive that end of the lever 54 which is extended through the slot 70 and into the bore 68. Since the pin 72 and adjusting screw 58 are on the opposite sides of the cross pin 56 carried by the tab 50, the pin 72 will move downwardly when the screw 58 drives the nut 62 upwardly and vice-versa. The pivot pin 72 slides freely in the bore 68, but little clearance exists for side play. The pin 72 may be extended far enough to project into the top of the door D (FIG. 2), and also may be retracted completely into the boss 48, in which case it is located beyond and disengaged from the door D. The lower portion of the pin 72 is chamferred and above the chamfer the pin 72 is provided with an outwardly opening circumferential groove 76 which contains an elastomeric O-ring 78. The pin 64 further contains an axially extending passageway or bore 80 which opens out of the lower end thereof and has a fitting 82 threaded into its upper end. Connected to the bore 80 at the fitting 82 is a flexible air line 84 which extends through the frame F and thence to a source of pressurized air.

The remainder of the upper pivot mechanism 20 consists of a bracket 90 secured to the top rail 14 of the door D by means of screws, and this bracket carries a cup or bushing 92 which is open at its upper end and closed at its lower end. The bushing 92 contains a bore 94, the axis of which aligns with the axis of the socket 34 at the bottom of the door D and hence is along the pivot axis X. The diameter of the bore 94 is such that the pin 72 will fit easily into it, but the elastomeric O-ring 78 will be compressed, thus forming an air-tight seal between the pin 72 and the bushing 92. Indeed, when the door D is mounted in the frame F, the pivot pin 72 is projected into the bore 94 of the bushing 92 to the extent that the O-ring 78 is contained wholly within the bushing 92. The closed lower end of the bushing 92 is provided with a fitting 96 which communicates with the bore 94. Connected to the bushing 92 is an air line 98.

The air line 98 extends through the hollow interior of the top rail 14 and thence downwardly through side rail 12 to a door mounted pneumatic appliance. This appliance may be a pneumatic lock 100 of the type disclosed in U.S. patent application Ser. No. 533,961. When pressurized air is directed to the lock 100, its bolt is projected into an aperture or keeper in the jamb 4, thus securing the door D in its closed position.

The air line 84 leading to the upper pivot arrangement 20 contains a valve (not shown) which when energized admits pressurized air to the portion of the line 84 beyond the valve. Since the line 98 in the door D is in communication with the line 84 through the upper pivot arrangement 20, the line 98 is likewise pressurized. Consequently, the lock 100 or other appliance is pressurized and operated. No leakage occurs at the upper pivot arrangement 20 because the O-ring 78 is compressed between the outer surface of the pin 72 and the surrounding surface of the bore 94 in the bushing 92, thus creating a fluid-tight seal between the pin 72 and the bushing 92. This fluid-tight seal exists irrespective of the position of the door D in the frame F.

Since the pressurized air is introduced into the door D through the upper pivot arrangement 20, the air lines 84 and 98 are completely concealed and inaccessible so that they cannot be tampered with or cut. Moreover, they do not flex with movement of the door D into and out of the door opening O.

The door D is removed by opening it partially to expose the slotted end of the adjusting screw 58. Then, with a screwdriver, the screw 58 is turned to draw the nut 62 downwardly which will retract the pivot pin 72 from the bushing 92. Once the pin 72 is withdrawn completely into the boss 48, the upper end of the door D is swung outwardly until it is clear of the frame F, and the entire door D is then lifted off of the roller 32 of the lower pivot arrangement 22.

This invention is intended to cover all changes and modifications of the example of the invention herein chosen for purposes of the disclosure which do not constitute departures from the spirit and scope of the invention.

What is claimed is:

1. In an entry structure including a door frame having spaced apart jambs and a header at the upper ends of the jambs, and a pivot device at the bottom of the door, the pivot device supporting the door and enabling the door to pivot about a vertical axis spaced slightly inwardly from one of the jambs, the improvement comprising: first means on the door at the upper end thereof defining a vertical bore which opens upwardly out of the door and having an opening therethrough, said opening communicating with said bore; a first fluid conduit connected with said opening in said first means so as to communicate with the bore, the first conduit leading to a fluid operated appliance on the door; second means on the header defining a vertical bore which is fixed in position with respect to the header and opens downwardly, the axis for the vertical bore of the second means being coincident with the axis of rotation for the door; a pin received in the bore of the second means and projecting downwardly therefrom into the bore of the first means so that the two bores are coaxial, the pin having a passageway extending axially through it with the lower end of the passageway opening into that portion of the bore in the first means which is located below the pin so that the passageway always communicates with the bore in the first means and the first fluid conduit irrespective of the angular position of the door; a second fluid conduit connected to the pin and communicating with the passageway therein seal means located between the pin and the walls of the bore in the first means to form a fluid barrier between the pin and the walls of that bore so as to prevent pressurized fluid from escaping along the pin, the seal means being positioned above said opening and also above the location at which the passageway in the pin opens into the bore of the first means, whereby the pressurized fluid will be transferred through the pin and into the second conduit without loss of pressure at the pin; and means for retracting the pin from the bore of the first means to free the upper end of the door from the header.

2. The arrangement according to claim 1 wherein the passageway in the pin opens out of the lower end face of the pin where it is in communication with the bore in the first means.

3. The arrangement according to claim 2 wherein the second conduit is connected with the passageway in the pin at the opposite end face of the pin.

4. The arrangement according to claim 2 wherein the seal means comprises an elastomeric O-ring encircling the pin and compressed against the pin by the walls of the bore of the first means.

* * * * *

UNITED STATES PATENT OFFICE

CERTIFICATE OF CORRECTION

Patent No. 3,964,207 Dated June 22, 1976

Inventor(s) Francis C. Peterson

It is certified that error appears in the above-identified patent and that said Letters Patent are hereby corrected as shown below:

Column 1, line 9, "some" should be "Some".

Column 5, line 19, (Claim 1), after "therein" a semicolon should be inserted.

Signed and Sealed this

Seventh Day of September 1976

[SEAL]

*Attest:*

RUTH C. MASON
*Attesting Officer*

C. MARSHALL DANN
*Commissioner of Patents and Trademarks*